United States Patent [19]

Goldberg

[11] 4,005,593

[45] Feb. 1, 1977

[54] BENDING CLAMP

[75] Inventor: Harold D. Goldberg, Hazelcrest, Ill.

[73] Assignee: Allied Tube & Conduit Corporation, Harvey, Ill.

[22] Filed: Aug. 20, 1975

[21] Appl. No.: 606,302

[52] U.S. Cl. ..... 72/213; 72/304; 72/389

[51] Int. Cl.[2] ..... B21D 7/04

[58] Field of Search ..... 72/308, 301, 305, 309, 72/316, 318, 320, 322, 213, 389, 369, 159, 304; 248/49, 79; 269/217

[56] References Cited

UNITED STATES PATENTS

| | | | |
|---|---|---|---|
| 2,525,403 | 10/1950 | Witt | 72/309 |
| 2,771,116 | 11/1956 | Ballard | 72/322 |
| 2,892,479 | 6/1959 | Holsclaw | 72/309 X |
| 3,869,917 | 3/1975 | Lapp | 72/304 |

*Primary Examiner*—Leon Gilden
*Attorney, Agent, or Firm*—Fitch, Even, Tabin & Luedeka

[57] ABSTRACT

A bending clamp is disclosed for use with a pipe bending apparatus having a generally arcuate shaped bending shoe about which a tubular pipe may be bent. The bending clamp is cooperable with the bending shoe to retain the pipe against the bending surface of the bending shoe so as to prevent wrinkling, flattening or collapse of the pipe during bending of the pipe.

7 Claims, 3 Drawing Figures

BENDING CLAMP

The present invention relates generally to apparatus for bending pipe, and more particularly to a novel bending clamp cooperable with the bending shoe of a pipe bending apparatus to retain a pipe against the bending surface during bending of the pipe.

Pipe bending apparatus are known which employ bending shoes having generally arcuate surfaces, concave in transverse cross-section, which receive a tubular pipe in abutting relation thereagainst during bending of the pipe. Such apparatus conventionally include means for engaging the pipe outwardly from the opposite ends of the bending shoe, and actuating means for effecting relative movement between the bending shoe and the outward pipe engaging means so as to effect bending of the pipe substantially along the arcuate bending surface of the bending shoe.

These known bending apparatus exhibit the disadvantage that pipes may not be retained against the concave arcuate bending surfaces of the bending shoes during bending, with the result that wrinkling, flattening or collapse of the pipes at the bend area may occur.

One of the primary objects of the present invention is to provide novel clamping means for use with pipe bending apparatus of the aforedescribed type, wherein the clamping means is adapted to retain the pipe against the apex of the bending surface and thereby prevent wrinkling, flattening or collapse of the pipe during a bending operation.

Another object of the present invention is to provide bending clamp means having a clamping block cooperable with the bending shoe of a pipe bending apparatus to retain a pipe against the apex of the bending surface during a bending operation, the bending clamp means including support arms for releasably securing the clamping block to the pipe bending apparatus.

A feature of the present invention lies in the provision of camming surfaces on the clamping block support arms which serve to urge the clamping block against the pipe to be bent during mounting of the bending clamp means onto the bending shoe.

Further objects and advantages of the present invention, together with the organization and manner of operation thereof, will become apparent from the following detailed description of the invention when taken in conjunction with the accompanying drawing wherein like reference numerals designate like elements throughout several views, and wherein.

Figure 1:
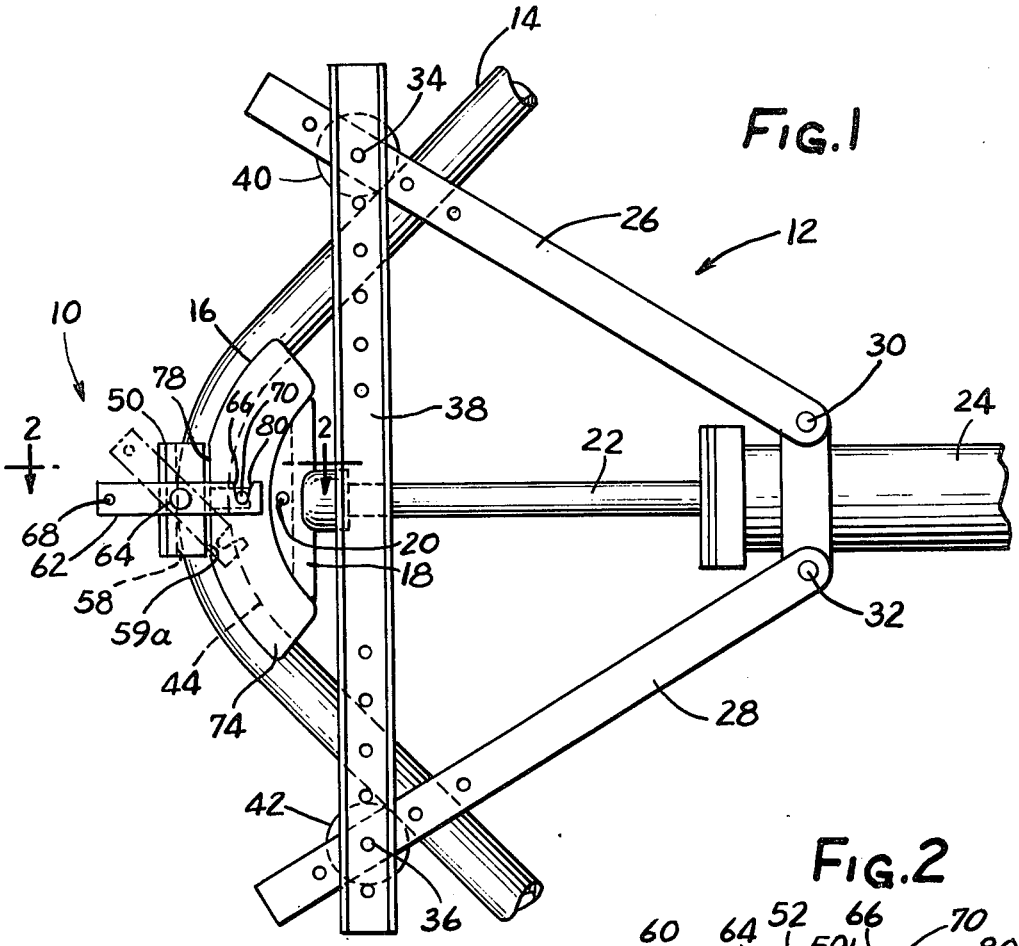
FIG. 1 is a top plan view of a pipe bending apparatus having a bending clamp associated therewith in accordance with the present invention.

Referring to the drawing, and in particular to FIG. 1, a bending clamp constructed in accordance with the present invention is indicated generally at 10. The bending clamp 10 is illustrated, by way of example, in conjunction with a pipe bending apparatus, indicated generally at 12. The pipe bending apparatus 12 is generally typical of many similar pipe bending apparatus of known design with which the bending clamp 10 may be employed. The pipe bending apparatus 12 is adapted to bend a length of pipe, a portion of which is indicated at 14, and to this end, includes a bending shoe 16 which, in the illustrated pipe bending apparatus 12, is secured to and supported by a shoe support member 18 through a mounting pin 20. The shoe support member 18 is secured on the outer end of a piston rod 22 which is selectively extendable from and retractable into a hydraulic or pneumatic cylinder 24 having conventional means (not shown) for effecting such extension and retraction of the piston rod 22. It will be appreciated that the bending shoe 16 may be mounted directly on the piston rod 22 without using a shoe support member such as 18.

Pairs of upper and lower connecting bars, the upper of each pair being indicated at 26 and 28, respectively, are pivotally connected at 30 and 32, respectively, to the cylinder 24 and have their opposite ends pivotally secured to connecting pins 34 and 36, respectively. A pair of upper and lower parallel spaced cross bars, the upper of which is shown at 38, have their opposite ends pivotally connected to the connecting pins 34 and 36 so as to establish a relatively fixed triangular configuration with the pairs of connecting bars 26 and 28. Pipe engaging members 40 and 42 are rotatably mounted on the pins 34 and 36, respectively, between the pairs of connecting bars and cross bars. The pipe engaging members 40 and 42 are adapted to engage the pipe 14 during a bending operation as is known. Conventionally, the connecting bars 26 and 28 and the cross bars 38 are provided with pin receiving openings along their lengths to allow selective positioning of the connecting pins 34 and 36 and thus varying of the positions of the pipe engaging members 40 and 42 relative to the pivotal connections 30 and 32.

The bending shoe 16 has an arcuate concave surface 44 which forms an abutment or bending surface against which a pipe is positioned during a bending operation. In such a bending operation, the piston 22 is fully retracted to allow insertion and positioning of the pipe 14 against the bending surface 44 of the bending shoe. The piston 22 may then be extended outwardly from the cylinder 24 to the position as shown in FIG. 1 to effect bending of the pipe 14 due to the fixed position of the pipe engaging members 40 and 42, as is known.

As noted, it has been found that during bending of pipe with apparatus as generally illustrated at 12, the portion of the pipe at the apex of the bending surface 44 on the bending shoe 16 may tend to move away from the bending surface. Should this occur, the pipe will frequently undergo wrinkling or flattening or partial collapse adjacent the apex of the bending surface of the bending shoe.

In accordance with the present invention, the bending clamp 10 is provided to cooperate with the bending shoe 16 to retain the pipe 14 against the apex of the bending surface 44 of the bending shoe so as to prevent the pipe from wrinkling, collapsing or flattening in the bend area during bending, as has heretofore been experienced. The bending clamp 10 includes a clamping block 50 having parallel side surfaces 52 and 54, an outer surface 56, which in the illustrated embodiment is curved about the longitudinal axis of the block, and a concave semi-cylindrical shaped surface 58 formed in the surface opposite the surface 56 so as to define lateral edge surfaces **59*a* and 59*b***.

A pair of parallel attaching arms 60 and 62 are pivotally connected to the clamping block 50 adjacent the side surfaces 52 and 54, respectively. The arms 60 and 62 may be pivotally secured to the clamping block 50 by axially aligned connecting bolts or pins 64 received through suitable openings in the attaching arms and secured to the clamping block. The attaching arms 60 and 62 have first end portions each of which has a transverse slot 66 formed therein, the slots 66 being of identical configuration and being equally spaced from the respective pivot pins 64.

Figure 2:
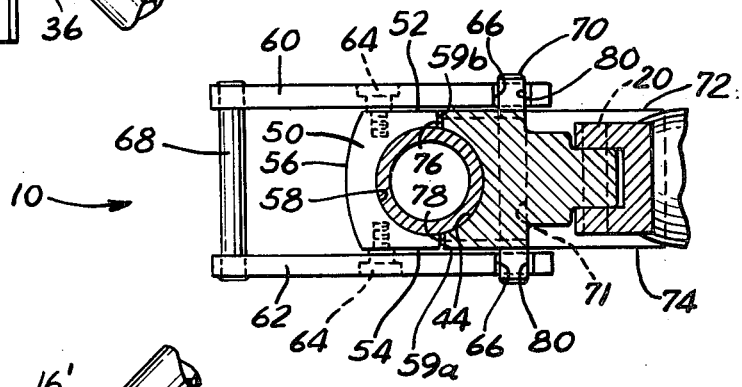
FIG. 2 is a partial vertical sectional view taken substantially along the line 2—2 of FIG. 1, looking in the direction of the arrows.

In the embodiment illustrated in FIGS. 1 and 2 a spacer shaft 68 is secured to and between the ends of the arms 60 and 62 opposite the slots 66 to maintain the arms 60 and 62 in parallel relation. The shaft 68 also serves as an operating handle to facilitate simultaneous movement of the arms 60 and 62 about the pivot pins 64 during mounting of the bending clamp 10 on the pipe bending apparatus 12 as will be hereinafter described. It will be appreciated that the arms 60 and 62 may be formed integral in substantially U-shape so as to eliminate the need for spacer shaft 68.

In the embodiment illustrated in FIGS. 1 and 2, the bending clamp 10 is mounted on the bending shoe 16. To this end, the bending shoe 16 is provided with a pin 70 which is retained within a suitable bore 71 through the bending shoe and extends outwardly from opposite parallel side surfaces 72 and 74 on the bending shoe 16. The bending shoe 16 is preferably formed with a pair of coplanar flat surfaces 76 and 78 (FIG. 2) which lie in a plane perpendicular to a plane containing the axis of pin 70 and passing through the apex of the arcuate forming surface 44.

In operation, when a pipe 14 is assembled within the pipe bending apparatus 12 so as to engage the bending surface 44 and the members 40 and 42 preparatory to bending the pipe as aforedescribed, the clamping block 50 is placed against the peripheral surface of the pipe 14 opposite the surface thereof engaging the apex of the bending surface 44, the attaching arms 60 and 62 being in pivoted positions as shown in phantom in FIG. 1. With the clamping block 50 so positioned against the pipe 14, the arms 60 and 62 are pivoted to positions wherein the outer extensions of pin 70 are received within the retaining slots 66 in the attaching arms. The slots 66 are located so that when the arms 60 and 62 are moved to positions wherein pin 70 is received within the slots 66, the clamping block is drawn against the pipe 14 to firmly retain the pipe against the apex of the bending surface 44 on the bending shoe 16. The slots 66 are defined in part by cam surfaces 80 which serve to draw the clamping block against the pipe 14 when the arms 60 and 62 are engaged with the pin 70 such that the pin is disposed at the innermost ends of the slots 66. In this manner, it can be seen that the clamping block 50 will retain the pipe 14 within and against the apex of the bending surface 44 in the bending shoe 16.

The depth of the concave surface 58 in the clamping block 50 is formed so that the sum of the radius of curvature of surface 58 and the radius of the concave bending surface 44 is slightly less than the outside diameter of the smallest size pipe to be bent with a selected bending shoe and associated clamping block. The center of curvature of the surface 58 in the clamping block is positioned relative to the plane of surface 59*a* and 59*b* so that when the clamping block is secured against the pipe 14 as described, the surfaces 59*a* and 59*b* will be spaced from the flat surfaces 76 and 78 on the bending shoe 16. It will be appreciated that the bending shoe 16 may have an arcuate profile adjacent the apex of the bending surface 44, it only being necessary that the surfaces 59*a* and 59*b* be spaced from the bending shoe when the clamping block is mounted thereon.

Figure 3:
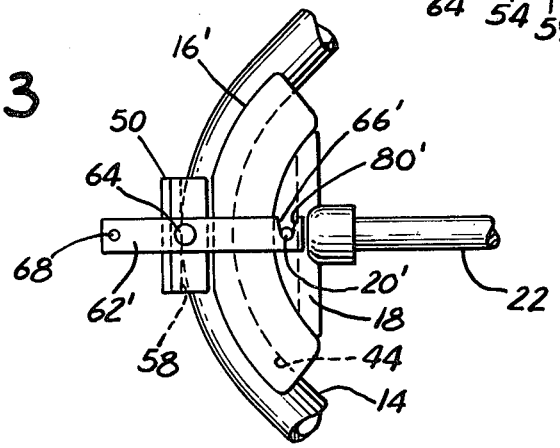
FIG. 3 is a partial plan view similar to FIG. 1 but showing an alternative manner of securing the bending clamp to the pipe bending apparatus.

FIG. 3 illustrates an alternative embodiment of a bending clamp in accordance with the present invention. The bending clamp of FIG. 3 is indicated at 10′ and is substantially identical to the above-described bending clamp 10. The bending clamp 10′ differs from bending clamp 10 in the provision of longer length attaching arms 60′ and 62′, only the upper arm 62′ being shown in FIG. 3. The attaching arms 60′ and 62′ have slots 66′ formed in their inner ends which are adapted to receive and be secured to axial extensions of mounting pin 20′ which secures the bending shoe 16′ to the shoe support member 18. By so attaching the bending clamp 10′ to extensions of the mounting pin 20′, the attaching pin 70 on the bending shoe 16 in FIGS. 1 and 2 need not be provided. The exact location or type of retaining or attaching pin on the pipe bending apparatus 12 for mounting the bending clamp 10 in accordance with the invention is not critical as long as the above-described clamping action on the pipe 14 to be bent is accomplished.

Thus, in accordance with the present invention, an easily manipulatable yet highly effective and inexpensive means has been provided for retaining pipes against the bending surfaces of bending shoes on pipe bending apparatus so as to prevent wrinkling, flattening or collapsing of the pipes during bending operations.

While preferred embodiments of the present invention have been illustrated and described, it will be obvious to those skilled in the art that changes and modifications may be made therein without departing from the invention in its broader aspects. various features of the invention are defined in the following claims:

What is claimed is:

1. For use with an apparatus for bending pipe which includes a bending shoe having a curved bending surface for engagement with a pipe during bending of the pipe, said pipe bending apparatus having attaching pin means thereon, clamping means including a clamping block and a pair of attaching arms pivotally to said clamping block and releasably cooperable with said attaching pin means for releasably securing said clamping block to said bending shoe adjacent the apex of said bending surface, said clamping block being adapted to retain a pipe against the apex of said bending surface so as to prevent wrinkling, collapsing or flattening of the pipe adjacent said apex surface during bending of the pipe.

2. For use with an apparatus for bending pipe which includes a bending shoe having a curved bending surface for engagement with a pipe during bending of the pipe, said pipe bending apparatus having attaching pin means thereon, clamping means including a clamping block and arm means cooperable with said attaching pin means for securing said clamping block to said bending shoe adjacent the apex of said bending surface, said clamping block being adapted to retain a pipe against the apex of said bending surface during bending of the pipe, said arm means comprising a pair of substantially parallel attaching arms pivotally connected to said clamping block, said arms having first end portions connectable to said attaching pin means to secure said clamping block to said bending shoe.

3. Clamping means as defined in claim 2 wherein said clamping block has a concave surface which is cooperable with the apex of said bending surface to retain a pipe therebetween when said clamping block is secured to said bending shoe.

4. Clamping means as defined in claim 2 wherein said bending shoe has generally parallel side surfaces, said attaching pin means projecting outwardly from each of said side surfaces, said attaching arms having slots therein for releasable connection to said attaching pin means.

5. Clamping means as defined in claim 4 wherein said slots are defined at least in part by cam surfaces cooperable with said pin means to urge said clamping block against an associated pipe and thereby urge said associated pipe against said bending surface during connection of said arms to said pin means.

6. Clamping means as defined in claim 2 wherein said attaching arms have second end portions opposite said first end portions, and including spacer bar means secured to and between said second end portions of said arms to maintain said arms in said substantially parallel relation.

7. Clamping means as defined in claim 3 wherein said concave surface of said clamping block is substantially semi-cylindrical, when considered in a transverse plane perpendicular to the longitudinal axis of said clamping block, said arms being pivotal relative to said clamping block between first positions facilitating placement of said concave surface against a pipe when engaging said apex of said bending surface, and second positions connecting said arms to said attaching means.

* * * * *

UNITED STATES PATENT AND TRADEMARK OFFICE

CERTIFICATE OF CORRECTION

PATENT NO. : 4,005,593

DATED : February 1, 1977

INVENTOR(S) : Harold D. Goldberg

It is certified that error appears in the above-identified patent and that said Letters Patent are hereby corrected as shown below:

Column 1, line 20: after "known" insert --pipe--.

Column 4, line 43 (Claim 1) : after "pivotally" insert --secured--.

Signed and Sealed this second Day of August 1977

[SEAL]

*Attest:*

RUTH C. MASON
*Attesting Officer*

C. MARSHALL DANN
*Commissioner of Patents and Trademarks*